United States Patent [19]

Batrack et al.

[11] Patent Number: 4,866,847

[45] Date of Patent: Sep. 19, 1989

[54] CUTTING TOOL FOR MATS AND THE LIKE

[76] Inventors: George A. Batrack; Gwendolyn C. Batrack, both of 2204 Primrose, Eugene, Oreg. 97402

[21] Appl. No.: 215,351

[22] Filed: Jul. 5, 1988

[51] Int. Cl.[4] ..... B26B 3/08

[52] U.S. Cl. ..... 30/293; 30/294

[58] Field of Search ..... 30/286, 294, 293, 296 R, 30/314, 329, 290

[56] References Cited

U.S. PATENT DOCUMENTS

| | | | |
|---|---|---|---|
| 2,098,641 | 11/1937 | Cook | 30/293 |
| 2,748,474 | 6/1956 | Brown | 30/296 R X |
| 3,085,330 | 4/1963 | Lewieski et al. | 30/293 |
| 3,837,078 | 9/1974 | Weppner | 30/293 |
| 4,148,142 | 4/1979 | Sullivan et al. | 30/294 |

FOREIGN PATENT DOCUMENTS

| | | | |
|---|---|---|---|
| 2036910 | 2/1972 | Fed. Rep. of Germany | 30/293 |

*Primary Examiner*—Douglas D. Watts

*Attorney, Agent, or Firm*—James D. Givnan, Jr.

[57] ABSTRACT

A tool for making both vertical and bevel cuts in sheet material and having a base supported by a pair of independently adjustable leg members. Brackets on the base carry a utility knife and circular knife holder which is positionable on bracket carried trunnions for different types of cuts. The trunnions additionally serve to secure the knife in the holder. A modified tool utilizes a threaded shaft to support a utility knife.

9 Claims, 1 Drawing Sheet

CUTTING TOOL FOR MATS AND THE LIKE

BACKGROUND OF THE INVENTION

The present invention pertains generally to hand held tools for cutting flat material such as mat boards, cardboard, foam board, etc., In common use today are hand held devices called utility knives which have a detachably mounted blade. The knives may be opened up to permit removal of a used blade for substitution of a new one. To the extent known, such knives are commonly used with a straight edge to make linear cuts.

A problem exists in the making of a precise cut without irregularities which, of course, would detract from mats used for decorative graphic presentations. Such is particularly so when a bevel cut is made as the knife must be held at a uniform inclination throughout the cut made for best results. Irregularities are particularly noticeable when the material cut is of some thickness such as foam board with the thicknesses up to ½ inch or so. Any wavering of the hand held utility knife results in a wasted board.

Mat cutting tools in the prior art are costly and require considerable skill in their use.

U.S. Pat. Nos. 2,098,641 and 4,148,142 disclose transversely positionable knives on a base for cutting along selected courses. U.S. Pat. No. 4,064,626 shows a knife with both vertical and inclined blades.

SUMMARY OF THE PRESENT INVENTION

The present invention is embodied in a knife holder, in combination with a knife, which makes precise cuts in sheet material at the desired blade angle i.e., vertical or inclined.

In the present tool, knife mounting means supports the knife component for rotation about a horizontal axis into and out of the material being cut. A modified form of tool includes knife mounting means which enables positioning of the knife in an inclined manner to enable the making of bevel cuts as, for example, when cutting a mat board for mounting artistic works.

In the cutting of mats and the like, it is common practice to use a straight edge. Any knife holder which is partially supported on the straight edge surface during cutting causes the cut to be somewhat off the vertical. This is particularly important where the material being cut is of some degree of thickness such as foam board. While foam board provides a desired three dimensional aspect to a displayed graphic, its use is severely restricted by the problems encountered in cutting same either vertically or beveled. As such material is more costly than conventional matting, with greater risk of spoilage, its use is curtailed by those making mats for room displays.

Important objectives of the present tool include the provision of a mat cutting tool capable of making vertical, as well as bevel or inclined cuts along a piece of mat material such as that material known as foam board; the provision of a tool with readily adjustable foot components for travel along surfaces of different heights with foot adjustment permitting a tool base to remain horizontal to assure a vertical cut; the provision of a cutting tool having a multi-position knife holder to permit convenient positioning of the knife component so as to make vertical or bevel cuts; the provision of a cutting tool capable of making a vertical cut even though foot members of the tool ride on different level surfaces with the knife component of the tool being laterally adjustable throughout a wide range of positions along the elongate base of the tool.

DETAILED DESCRIPTION OF THE PREFERRED EMBODIMENTS

Figure 1:
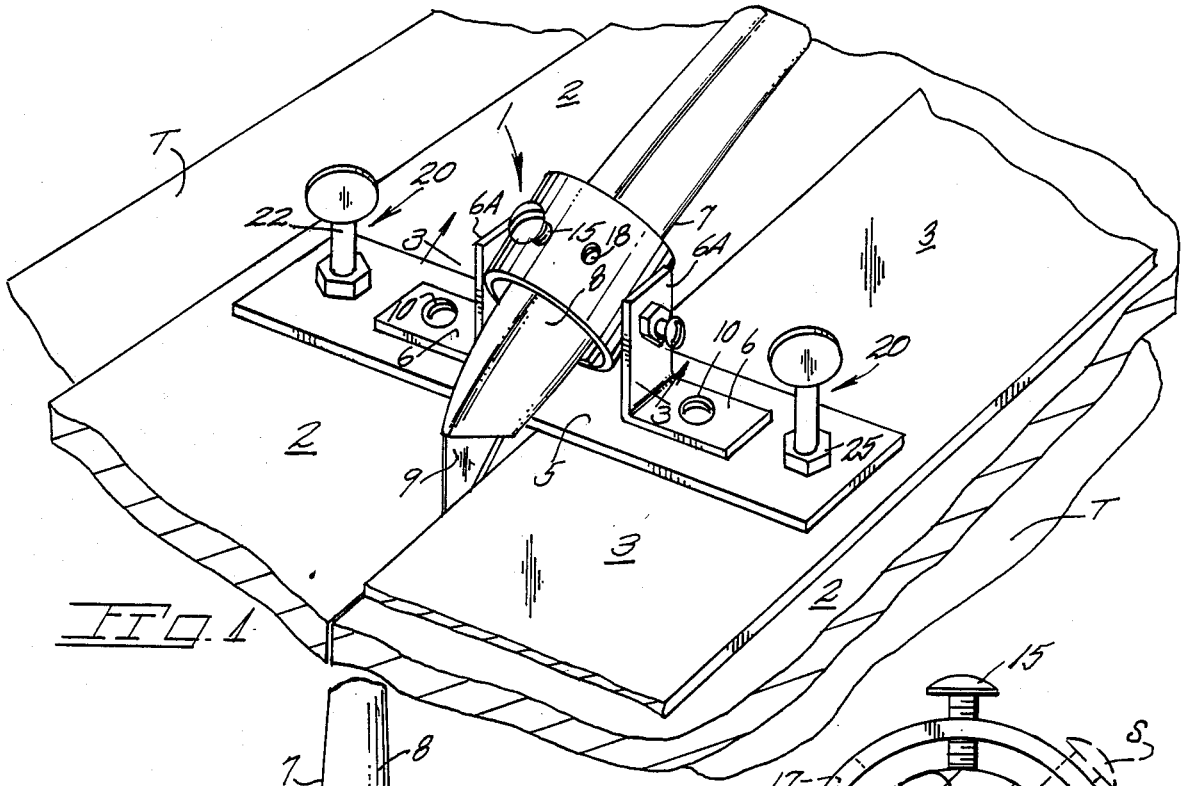
FIG. 1 is a perspective view of the present tool in use cutting along a straight edge.

With continuing attention to the drawings wherein applied reference numerals indicate parts similarly hereinafter identified, the reference numeral 1 indicates generally the present cutting tool shown in use cutting a mat 2 using a straight edge 3. Typically such a task is accomplished on a table surface at T.

The present tool includes an elongate base 5 equipped with brackets at 6. A knife 7 includes a handle 8 as well as a blade 9 with such knives being widely used by workmen for a myriad of cutting tasks. The blade at 9 is mounted in a removable manner for blade replacement purposes. Such knives are termed in the trade utility knives.

Figure 2:
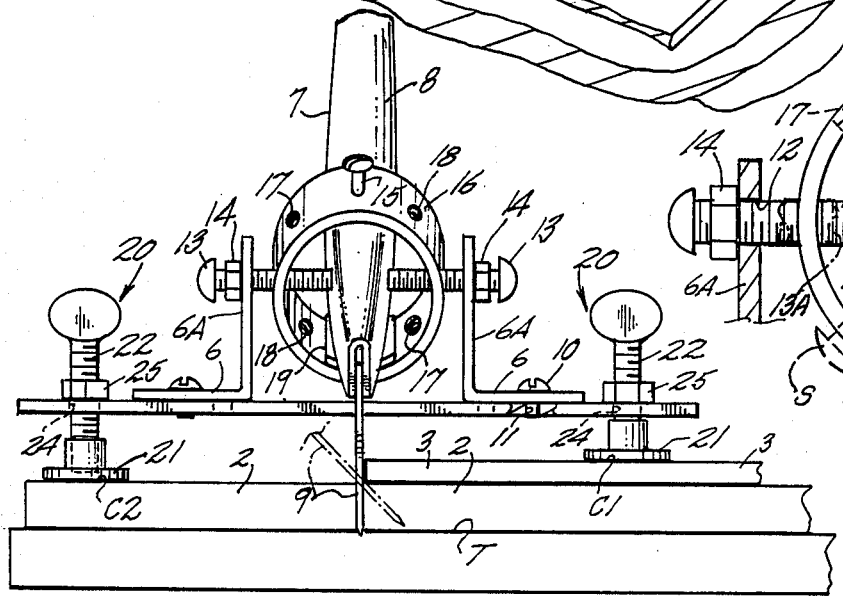
FIG. 2 is a front elevational view thereof.

With attention again to brackets 6, the same are secured to base 5 by threaded fasteners at 10 which pass through the bracket and terminate in threaded engagement with threaded bores 11 (FIG. 2) in base 5. The upright extension at 6A of each bracket includes a threaded aperture 12 to facilitate equipping each upright extension 6A with a pair of screws 13 which serve as trunnions and may be adjusted axially and then locked in place by lock nuts 14. The inner ends 13A of screws 13 are adjustable into abutting engagement with the sides of knife handle 8 as viewed in FIG. 2. Similarly, a set screw at 15 is in threded engagement with a knife holder 16 with inward advancement of set screw 15 serving to bias knife handle 8 into engagement with a resilient pad 19 affixed interiorally to holder 16. Accordingly, the knife handle 8 may be secured in a positive manner within holder 16 to avoid any risk of knife dislodgment from the holder. Additionally, holder 16 is provided with a second pair of diametrically opposed threaded bores indicated at 17 which receive the screws 13 upon arcuate repositioning of holder 15 from the FIG. 2 position to align the threaded bores 17 with the screws which, of course, are backed off during positioning of holder 15. Such repositioning of the holder 15 results in the tool being shifted laterally from the FIG. 2 position and blade 9 moving to the broken line position of FIG. 2 for the purpose of making a bevel or inclined cut. Such cuts are commonly done on paper mats for the mounting of photos and art work but, as earlier noted, were heretofore difficult to perform on thick mats.

Indicated generally at 20 are leg members located one each adjacent an end of elongate base 5 with the leg members each terminating downwardly in a foot member 21 carried by a threaded shank 22 of each leg member. The shanks 22 are preferably each in threaded engagement with an internally threaded aperture 24 on base 5 with a lock nut 25 permitting setting of the foot members 21 at a vertical distance below base 5. Typically the selected vertical distance between the foot members 21 will vary as it is common that the foot members will travel, during a cutting operation, along courses C1 and C2 of different heights from a common reference plane such as table top T.

Figure 3:
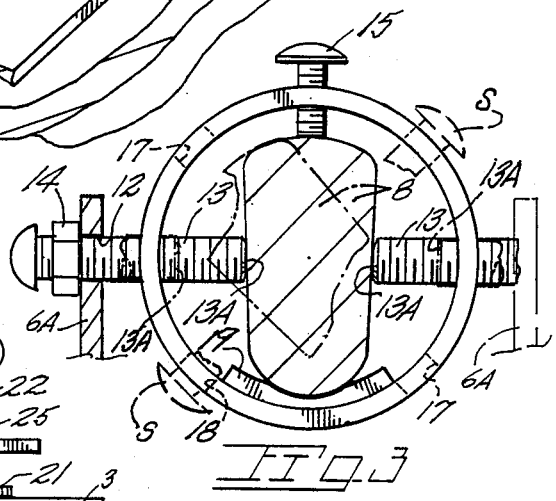
FIG. 3 is an elevational view taken along line 3—3 of FIG. 1 showing details of the knife holder.

The broken line position of the knife handle 8 in FIG. 3 indicates the handle position for performing a bevel cutting operation. Setting of the shanks 22, shown as thumbscrews, permits base 5 of the tool to be parallel to the mat 2 with the blade 9 precisely perpendicular to the mat regardless of various straightedge thicknesses or whether or not both foot members 21 travel in an elevated manner above the mat.

Figure 4:
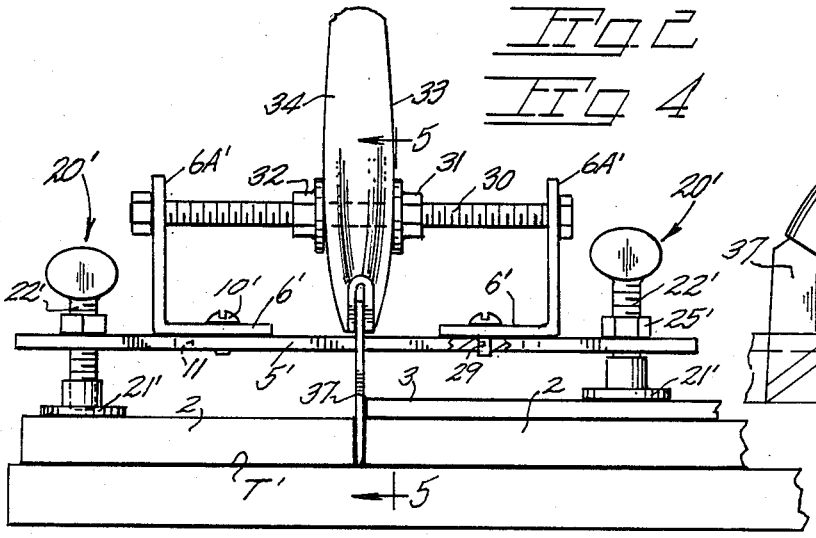
FIG. 4 is a front elevational view similar to FIG. 2 but showing a modified form of the tool.
Figure 5:
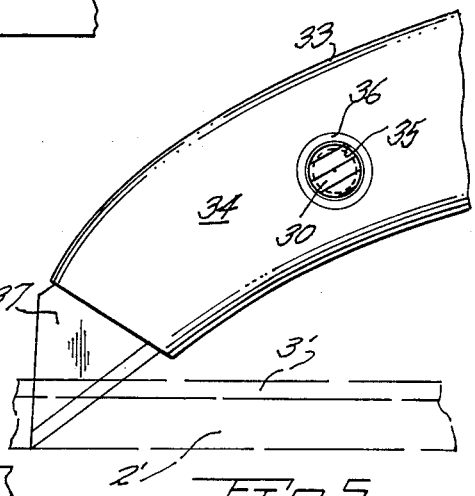
FIG. 5 is a vertical sectional view taken approximately along line 5—5 of FIG. 4.

The modified form of tool shown in FIG. 4 includes components identified by prime reference numerals which components correspond to those earlier identified by base number reference numerals. The brackets 6' are reinstalled on base 5' so as to increase the span between their upright extensions 6A'. Threaded bores as at 29 in base 5' receive the screws 10'. Knife mounting means includes a bolt and nut assembly 30 which extends between said upright extensions. Traveler nuts 31–32 include integral flanges to abut opposite sides of a utility knife 33 having a handle 34 which is of the well-known type having a horizontal transverse opening 35 therethrough. The opening is defined by knife pivot means 36 which permits the two-piece knife handle 34 to swing open for the purpose of removal and reinstallation of a new blade 37. The leg members generally at 20' function in the manner of their earlier described counterparts.

The modified form of tool functions with the knife 33 being positionable about the horizontal axis of bolt and nut assembly 30 with the traveler nuts providing a degree of friction to inhibit the knife from accidental movement about said axis. Blade replacement is unhindered by such knife mounting means.

In both forms of the present tool blade, exposure is such as to permit thé cutting of all commonly used mat materials and thicknesses. The tool lends itself to right or left hand use with little or no change in tool configuration.

When the knife is inclined per the broken line position of FIG. 3, knife securement within holder 16 (supported by backed off screws 13) is supplemented by a pair of set screws at 5 in threaded engagement with aligned pairs of threaded bores 17 or 18 with each of said pairs of set screws terminating inwardly in abutment with opposite sides of knife handle 8. When the handle is inclined in the other direction, to suite individual right or left hand preference, then said pair of set screws S will be relocated in threaded engagement with the remaining pair of bores 17 or 18 to abut the knife handle.

The present cutting tool is very useful in the cutting and laying of vinyl floor covering where abutting seam edges must be void of gaps. Such a seam is accomplished by the inclining of the knife and blade 9 or 37 about ten degrees or less by extending a single leg member 20 or 20' to lengthwise incline base 5 or 5'. A cut so made provides slightly beveled cut surfaces with any gapping prevented by the fact that the cut surfaces overlie one another. Such cutting operations also utilize a straightedge.

While we have shown but a few embodiments of the invention, it will be apparent to those skilled in the art that the invention may be embodied still otherwise without departing from the spirit and scope of the invention.

Having thus described the invention, what is desired to be secured by a Letters Patent is:

We claim:

1. A cutting tool for cutting a planar workpiece and for use with a straightedge and comprising in combination, an elongate base, a knife including a handle and a blade, knife mounting means in place on said base, said knife mounting means including horizontal pivot means embodied in a pair of trunnions and a holder carrier by said trunnions and through which said knife extends, and leg members one each located adjacent an end of said base, said leg members each including a foot for travel along a horizontal surface, adjustable threaded means permitting vertical adjustment of at least one foot whereby upon raising or lowering of said one foot said base will be parallel to the workpiece regardless of each foot moving along a supporting surface at a different height than the remaining foot.

2. The tool claimed in claim 1 wherein said adjustable threaded means includes screw threads on at least one of said leg member.

3. The tool claimed in claim 2 wherein said adjustable threaded means additionally includes screw threads on said base in engagement with said scrw threads on said one of said leg members.

4. The tool claimed in claim 1 wherein said holder is circular with multiple pairs of sockets for selected engagement with said trunnions to permit the knife to be inclined relative a workpiece for making a bevel cut.

5. A mat cutting tool comprising in combination, a base, leg members supporting said base and adapted for travel during a cutting operation along parallel courses, a knife including a knife handle, a knife holder, bracket means on said base including trunnions on which said holder is movably mounted, and said knife holder having a set of trunnion receiving openings and of open configuration, setscrews on said knife holder for engagement with said knife handle disposed within said holder.

6. A mat cutting tool for adjustably supporting a utility knife of the type having a knife handle and a replaceable blade carried by said handle, said tool comprising, a base, leg members supporting said base and adapted for travel during a cutting operation along parallel courses, a knife holder for said utility knife, said holder of open configuration, setscrews in said knife holder for engagement with said knife handle disposed with said holder, bracket means on said base including trunnions on which said holder is movably mounted, and said knife holder having a set of trunnion receiving openings.

7. The tool claimed in claim 1 wherein said set screws are in axial alignment and oppositely abut the knife handle.

8. The tool claimed in claim 1 wherein at least one of said leg members is adjustable relative said base.

9. A cutting tool for cutting a planar workpiece and for use with straightedge and comprising in combination, an elongate base, a knife including a handle and a blade, said handle defining an opening, knife mounting means in place on said base, said knife mounting means including horizontal pivot means embodied in a shaft of substantially greater length than handle width and extending crosswise through said opening in the knife handle to permit knife movement along and about said shaft, nut elements on said shaft to confine said knife against lateral displacement from a selected position along said shaft, and leg members one each located adjacent an end of said base, said leg members each including a foot for travel along a horizontal surface, means for locking at least one of said leg members to said base in an axially adjustable manner to permit foot travel over surfaces of different levels without causing inclination of said base.

* * * * *